US007891694B2

(12) United States Patent
Schamesberger

(10) Patent No.: US 7,891,694 B2
(45) Date of Patent: Feb. 22, 2011

(54) METHOD FOR MACHINING THE RUNNING SURFACES OF WINTER SPORTS APPLIANCES

(75) Inventor: Robert Schamesberger, Eisenstadt (AT)

(73) Assignee: Atomic Austria GmbH, Altenmarkt (AT)

( * ) Notice: Subject to any disclaimer, the term of this patent is extended or adjusted under 35 U.S.C. 154(b) by 0 days.

(21) Appl. No.: 11/486,079

(22) Filed: Jul. 14, 2006

(65) Prior Publication Data

US 2006/0251486 A1 Nov. 9, 2006

(30) Foreign Application Priority Data

Jul. 14, 2005 (AT) ..... A 1189/2005

(51) Int. Cl.
*A63C 5/044* (2006.01)

(52) U.S. Cl. ..... 280/609; 280/601; 280/610

(58) Field of Classification Search ..... 280/600–610
See application file for complete search history.

(56) References Cited

U.S. PATENT DOCUMENTS

| | | | | |
|---|---|---|---|---|
| 3,652,102 | A * | 3/1972 | Eaton | 280/610 |
| 4,320,908 | A * | 3/1982 | Ellingsen et al. | 280/604 |
| 4,495,398 | A * | 1/1985 | Bredow et al. | 219/121.67 |
| 5,328,200 | A * | 7/1994 | Pelizzari | 280/609 |
| 5,447,463 | A * | 9/1995 | Schmitz | 451/14 |
| 5,725,237 | A * | 3/1998 | Krafft et al. | 280/609 |
| 5,785,578 | A * | 7/1998 | Thoresen et al. | 451/14 |
| 4,359,077 | A1 | 5/2007 | Riepler et al. | |
| 2006/0124701 | A1* | 6/2006 | Chen et al. | 228/112.1 |

FOREIGN PATENT DOCUMENTS

| | | | |
|---|---|---|---|
| DE | 6805154 | | 11/1968 |
| DE | 2621490 | | 12/1977 |
| DE | 4013901 | | 10/1991 |
| DE | 4013901 | A1 * | 10/1991 |
| DE | 10130392 | | 1/2003 |
| DE | 10243310 | | 4/2003 |
| EP | 1415686 | | 4/2005 |
| FR | 2112645 | | 5/1972 |
| GB | 1357721 | | 6/1974 |
| WO | 03045510 | | 6/2003 |
| WO | 03061783 | | 7/2003 |

OTHER PUBLICATIONS

English Abstract of EP 1415686.
English Abstract of DE 4013901.
English Abstract of DE 10130392.
English Abstract of DE 4013901, Oct. 1991.
English Abstract of DE 10130392, Jan. 2003.

* cited by examiner

*Primary Examiner*—J. Allen Shriver, II
*Assistant Examiner*—Katy Meyer
(74) *Attorney, Agent, or Firm*—Dykema Gossett PLLC

(57) ABSTRACT

The invention relates to a method for machining the running surfaces (9) of winter sports appliances such as skis or snowboards, in which a blank track (20) is subjected to a machining process in order to obtain a predetermined surface microstructure which improves the gliding ability. A precisely defined and reproducible surface structure of the track is achieved in such a way that the machining process for producing the surface microstructure comprises a plastic deformation by a tool (5, 5*a*) which is moved over a running surface (9) of the track blank (20) and is pressed with a predetermined force on the track blank (20) in order to deform the same in a plastic manner. The invention further relates to a winter sports appliance which is produced with such a method and an apparatus for performing the method.

7 Claims, 3 Drawing Sheets

METHOD FOR MACHINING THE RUNNING SURFACES OF WINTER SPORTS APPLIANCES

BACKGROUND OF THE INVENTION

The invention relates to a method for machining the running surfaces of winter sports appliances such as skis or snowboards, in which a blank track is subjected to a machining process in order to obtain a predetermined surface microstructure which improves the gliding ability.

DESCRIPTION OF PRIOR ART

The gliding of a winter sports appliance such as a ski on snow represents a special kind of a frictional case. The reason is that the individual parties in the friction such as the track, snow and interposed water film are difficult to describe and are changeable. It is known that the frictional resistance can be positively influenced under certain circumstances by a purposeful roughening of the surface of the respective object under conditions as are present in skis, but also other conditions such as relate to boats and aircraft. One reason for the improved gliding properties of rough surfaces of the running surface materials of skis lies in the fact that suction effects at higher speeds can be reduced or avoided.

Polyethylene has prevailed substantially as the material for producing running surface materials for skis. The special advantages of polyethylene, especially with medium and high molar mass, are the favorable wearing and gliding behavior, high tenacity and exceptional resistance to chemicals on the other hand. These advantages, and especially the abrasion resistance, rise with increasing molar mass, so that ultrahigh-molecular polyethylene with a molar mass of several million are used especially for critical applications such as racing sports. The production and machining of running surface materials made from ultrahigh-molecular polyethylene is difficult because this material cannot be extruded and is extremely difficult to deform.

In practice, the surface structures required for improving the gliding properties are mostly applied by grinding processes, which entails certain disadvantages however. On the one hand, it is hardly possible to achieve an even surface roughness as a result of unavoidable thickness tolerances in the production of the track blanks because the thickness tolerances are larger than the depth of the structure to be produced. It is thus unavoidable that the surface properties such as roughness depth depend on the locally present thickness fluctuations of the track blank and are thus uneven and not reproducible. A further disadvantage of grinding methods is that as a result of the unavoidable local heating of the running surface undesirable chemical changes occur which have an adverse effect on the gliding properties. Moreover, chemical interactions may occur between the grinding material and the running surface material, leading to a further impairment.

It is known from WO 03/061783 that the structuring of a ski track can be subdivided into a macrostructure and a microstructure. Structures with a depth>20 μm are designated as macrostructures. Microstructures concern smaller structures. It is determined within this specification correctly that in practice the structuring is produced by grinding of the surface, as described above. Only the macrostructure can be produced in a reproducible manner however. The microstructure in particular depends on a large number of parameters that cannot be influenced directly, so that even under identical production conditions there are strong differences in the gliding behavior. In order to avoid such disadvantages it is proposed in WO 03/061783 to structure a track by an embossing method, such that an embossing roller is allowed to roll over the track in order to produce a microstructure.

Such embossing methods meet increasing difficulties with increasing molar mass of the track because a plastic deformation is only possible within very strict limits as a result of the reduced flow characteristics. In addition, the above-mentioned irregularities occur as a result of the thickness tolerance because the local pressure of the embossing tool on the surface of the track is influenced very strongly by the thickness fluctuations in the track itself. As a result of these facts, it is hardly possible with such a method, especially in the case of high-molecular running surfaces, to produce reproducible surface structures. Such an embossing method is also disclosed in DE 102 43 310 A. EP 1 415 686 A further describes a modified embossing method which is also not able to remedy the above disadvantages.

DE 40 13 901 A describes a method for profiling the running surfaces of back-country skis. Scale-like structures are produced primarily in the area of the binding which are to improve the ascending behavior. Such structures must have typical sizes which lie above the macrostructures, as described above. A machining tool is guided in a sliding motion over the running surface. It is not known to use such a method or a similar one for producing microstructures.

SUMMARY OF THE INVENTION

It is the object of the present invention to provide a method with which the above disadvantages are avoided and which allows producing a precisely defined and reproducible surface structure of a track for a winter sports appliance. The highest possible degrees of freedom shall be allowed in the geometrical configuration of the surface structure. The method shall further not have any influence on the chemical composition and properties.

It is a further object of the present invention to provide a winter sports appliance with a running surface which as a result of its surface structure offers optimal gliding properties. Moreover, an apparatus shall be provided for producing such a track.

These objects are achieved in accordance with the invention by a method which is characterized in that the machining process for producing the surface microstructure comprises a plastic deformation by a tool which is moved over a track blank and is pressed with a predetermined force on the running surface of the track blank in order to deform the same in a plastic manner. Depressions or elevations with a typical height dimension of less than 0.02 mm are designated as microstructure. It is has been noticed that as a result of a plastic deformation which is caused by a relative movement of the tool with respect to the surface of the track or track blank it is possible to create a surface structure which is characterized by local displacement of material. A relevant aspect of the present invention is that the production of the surface structure is controlled by force, which means that the force with which a tool is pressed against the running surface is substantially independent of local thickness fluctuations as a result of production tolerances or the like. As a result, the above disadvantages can be avoided and an even and completely reproducible surface structure is especially achieved without any deterioration of the chemical properties.

An especially advantageous embodiment of the method in accordance with the invention provides that in the case of a deformation of the track blank at least one tool tip is guided in a sliding motion over the running surface of the track blank. Such a method is known in another connection as guilloching.

It concerns an engraving method originating from metal working and has been used some time ago for producing high-quality clocks. A diamond cone is used in an especially preferred manner for this method because as a result of the high hardness extreme abrasion resistance is given and there is no chemical influence on the surface as a result of the inert material.

It is especially advantageous when the tool tip has a radius of approximately 0.02 mm. Microstructures of optimal size can be produced in this manner.

Especially advantageous gliding properties are achieved when the tool is moved at least in sections at a predetermined angle relative to the longitudinal direction of the track blank. If this angle concerns a right angle, the produced grooves extend transversally to the riding direction, which offers advantages in certain snow conditions. It is also possible to provide wave patterns, with both embodiments offering advantages over the known arrangement of longitudinal grooves on the track surface which are caused by the process.

An especially advantageous variant of the method in accordance with the invention is characterized in that the machining process on the track blank comprising the plastic deformation occurs prior to the application on the winter sports appliance. Guiding the method in such a way has a number of advantages. On the one hand, it is possible to work on plane base which will not curve in the longitudinal direction like an assembled ski and which is not pre-tensioned. A further advantage of this method variant is that it is not necessary to take into account any steel edges when machining the track. The track blank will be cut to size precisely before and after the machining and fit snugly into the recess between the steel edges. Preferably, the machining occurs on a coordinate table, which is a working appliance in which a tool can be moved like a plotter in the longitudinal and transverse direction over the workpiece.

The present invention further relates to a winter sports appliance with a running surface, preferably made of polyethylene, whose running surface has a predetermined structure.

Such a winter sports appliance is characterized in accordance with the invention in such a way that the structure is produced by plastic deformation. It has been seen that such winter sports appliances show special advantages especially in critical applications such as racing sports, i.e. at very high speeds, and when using high-quality materials such as ultra-high-molecular polyethylene.

It is especially advantageous for the gliding properties in this connection when the structure is formed as a groove structure with even depth. It has further proven to be advantageous when the surface structure is composed of predetermined geometrical patterns. Chemical changes to the running surface can be avoided in such a way that the surface structure is produced by chipless machining.

The invention further relates to an apparatus for producing tracks of winter sports appliances with a tool guidance for guiding a tool which applies a predetermined surface structure to a running surface of the track. According to the embodiment in accordance with the invention, such an apparatus is characterized in that the tool is arranged for providing plastic deformation to the running surface and can be pressed with a predetermined force against the running surface of the track blank.

The machining output can be improved in an especially advantageous manner in such a way that several tools are provided on the tool guide for simultaneous machining of the running surface of the track blank. This allows machining a ski track as in conventional processes simultaneously over its entire width without losing the advantages as described above. It is especially advantageous in this connection when the individual tools are held in a resilient manner independent of each other. This ensures that each individual tool can adjust optimally to the respective local fluctuations in thickness. Other solutions are also possible as an alternative to the above, e.g. a hydraulic bearing of the individual tools. An optimal adjustment of the surface structure to the respective required gliding and riding properties of the winter sports appliance can occur in an especially preferred manner in such a way that the tool guidance comprises a control unit for producing predetermined patterns on the running surface of the track blank.

The present invention is explained below in closer detail by reference to embodiments shown in the drawings, wherein:

DETAILED DESCRIPTION OF PREFERRED EMBODIMENTS

Figure 1:
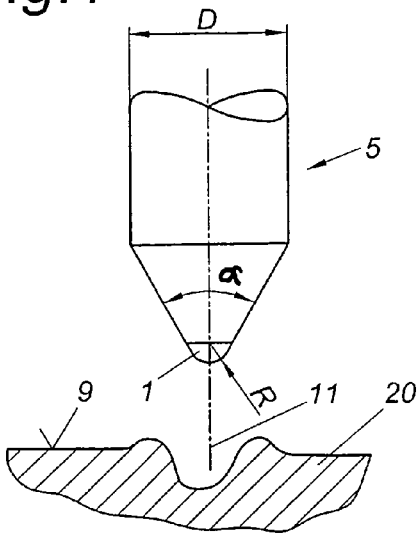
FIG. 1 schematically shows a detail of an individual tool in a view.

The tool of FIG. 1 concerns an engraving diamond 5 with a shaft diameter D of 3 mm for example, a cone angle $\alpha$ of 60° and a radius R of the diamond tip 1 of 0.02 mm. The track blank is indicated with reference numeral 20.

Figure 2:
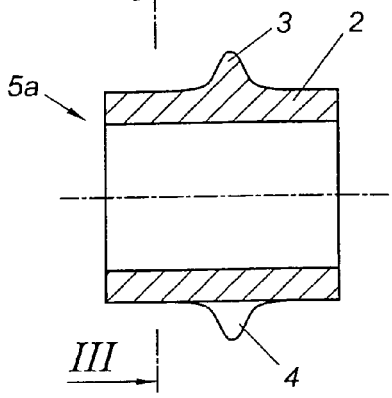
FIG. 2 shows an alternative embodiment of a tool in a sectional view.
Figure 3:
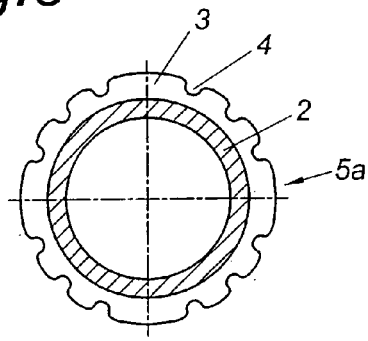
FIG. 3 shows a sectional view along line III-III of FIG. 2.

FIG. 2 shows a cutting wheel 5*a* which consists of a cylindrical main body and a circumferential projection 3. FIG. 3 shows that the projection 3 comprises interruptions 4 which are distributed along the circumference.

Figure 4:
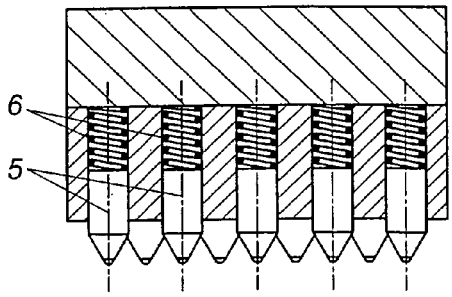
FIG. 4 shows a multiple tool.

FIG. 4 shows a multiple tool in which several diamond pins 5 are displaceable adjacent to one another in the longitudinal direction and are each pre-tensioned by a spring 6. Further pins are arranged with a gap in between behind the pins 5 of the first row in order to enable producing a higher groove density.

Figure 5:
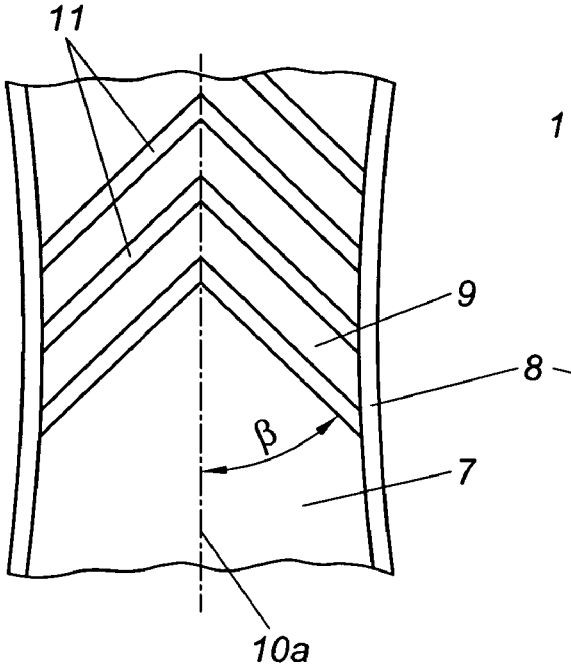
FIG. 5 to FIG. 8 show different embodiments for machining the track.

FIG. 5 schematically shows a section of a ski 7 with an exaggerated sidecutting. The steel edges 8 delimit the running surface 9. A plurality of grooves 11 is arranged at an angle $\beta$ relative to the longitudinal axis 10*a*, which angle $\beta$ is approximately 45° in the present example.

Figure 6:
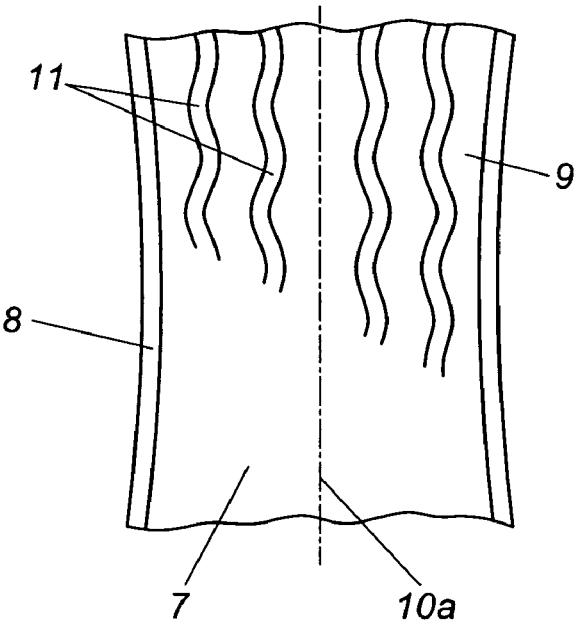
Figure 7:
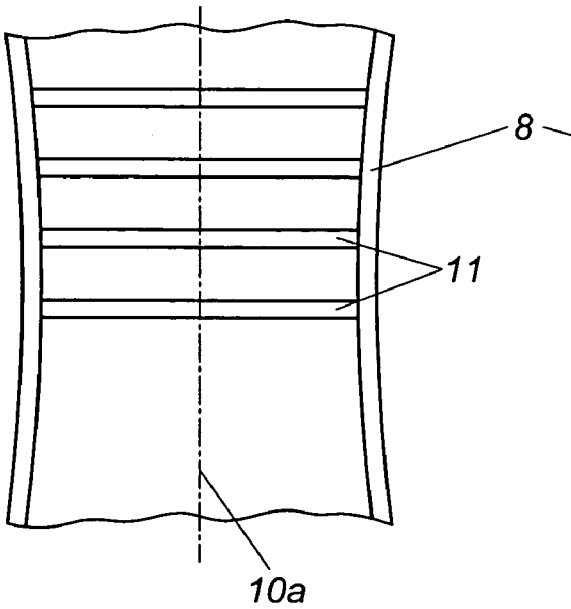

In the embodiment according to FIG. 6, the grooves 11 are substantially arranged in the longitudinal direction and provided with a wave-like configuration. The variant of FIG. 7 corresponds substantially to that of FIG. 5 with the difference that the grooves 11 are arranged transversally to the longitudinal axis 10*a*.

Figure 8:
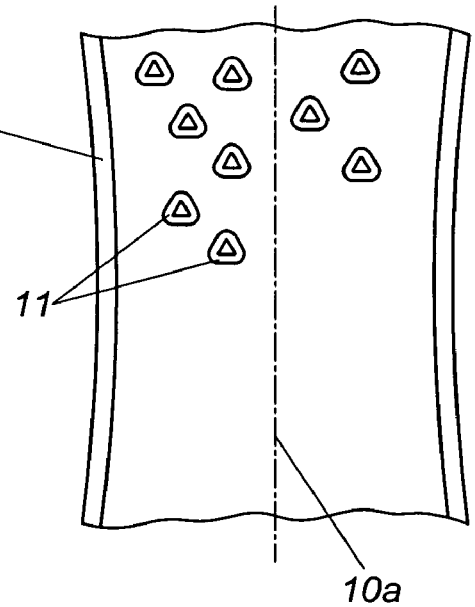

In the embodiment of FIG. 8, the grooves 11 are present in the form of triangular structures which are arranged with gaps over the track 9 in a distributed manner.

Figure 9:
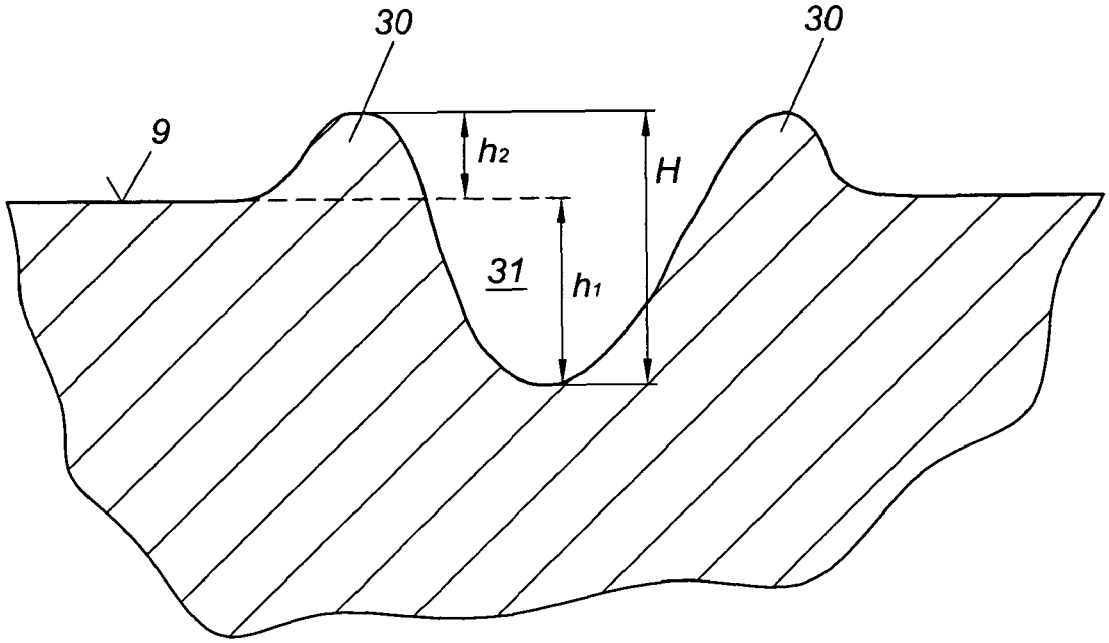
FIG. 9 shows a detail of FIG. 1.

FIG. 9 shows the surface structure of FIG. 1 in detail. A depression 31 is delimited by two elevations 30 which have been produced by displacement of material. The vertical dimensioning of the depression 31 is designated with $h_1$ and is approximately 0.015 mm. The vertical dimension of the elevation 30 is designated with $h_2$ and is approximately 0.01 mm. The total height H is thus approximately 0.025 mm.

Since $h_1$ as well as $h_2$ are smaller than 0.02 mm, this concerns a microstructure within the terms of the invention.

What is claimed is:

1. A method for machining running surfaces of winter sports appliances in which a track blank is subjected to a machining process in order to obtain a predetermined surface microstructure which improves gliding ability, comprising the steps of:

providing a tool which has at least one tool tip, and guiding said tool in a sliding motion over a running surface of the track blank which is located on a coordinate table, said running surface consisting of polyethylene, and pressing said at least one tool tip with a predetermined force on the track blank in order to form permanent depressions or elevations in the running surface in a plastic manner and provide a predetermined surface microstructure therein in a chipless fashion and without changing the chemical composition or chemical properties of the track blank.

2. A method according to claim 1, wherein said at least one tool tip is configured as a diamond cone.

3. A method according to claim 1, wherein said at least one tool tip has a radius of approximately 0.02 mm, and wherein the predetermined force causes the at least one tool tip to penetrate the track blank less than 0.02 mm.

4. A method according to claim 1, wherein the tool is held in a resilient manner and is pressed on the running surface of the track blank.

5. A method according to claim 1, wherein the tool is moved at least in sections at a predetermined angle relative to the longitudinal axis of the track blank.

6. A method according to claim 1, wherein the tool is guided in wave-like movements over the track blank.

7. A method according to claim 1, including a step of applying the track blank to a winter sports appliance.

* * * * *